US011536287B2

(12) United States Patent
Pelton et al.

(10) Patent No.: US 11,536,287 B2
(45) Date of Patent: Dec. 27, 2022

(54) DUAL IMPELLER

(71) Applicant: HANWHA POWER SYSTEMS CO., LTD, Changwon-si (KR)

(72) Inventors: Robert Pelton, Houston, TX (US); Karl Wygant, Houston, TX (US)

(73) Assignee: HANWHA POWER SYSTEMS CO., LTD, Changwon-si (KR)

( * ) Notice: Subject to any disclaimer, the term of this patent is extended or adjusted under 35 U.S.C. 154(b) by 280 days.

(21) Appl. No.: 15/830,196

(22) Filed: Dec. 4, 2017

(65) Prior Publication Data

US 2019/0170155 A1 Jun. 6, 2019

(51) Int. Cl.
*F04D 29/28* (2006.01)
*F04D 17/12* (2006.01)

(52) U.S. Cl.
CPC ..... *F04D 29/286* (2013.01); *F04D 17/12* (2013.01)

(58) Field of Classification Search
CPC ..... F04D 29/286; F04D 17/12; F04D 17/127; F04D 29/185; F04D 29/2211
See application file for complete search history.

(56) References Cited

U.S. PATENT DOCUMENTS 2,647,685 A * 8/1953 Srogi ..... F04D 29/2211 416/186 R
2,827,261 A * 3/1958 Parker ..... F04D 25/166 415/77
5,105,616 A * 4/1992 Bornemisza ..... F02C 3/05 60/726
6,499,953 B1 12/2002 Bellerose et al.
7,324,339 B2 1/2008 Foster, Sr. et al.
D602,142 S 10/2009 Nishizawa et al.
7,870,731 B2 * 1/2011 Fledersbacher ..... F04D 29/4213 60/605.1
9,638,208 B2 * 5/2017 Tomita ..... F04D 29/30
10,330,102 B2 * 6/2019 Ishikawa ..... F04D 17/10
2012/0051885 A1 * 3/2012 Danguy ..... F04D 29/2211 415/99
2013/0266450 A1 * 10/2013 Tomita ..... F04D 29/284 416/223 R
2015/0063989 A1 * 3/2015 Wang ..... F04D 27/0253 415/157

(Continued)

FOREIGN PATENT DOCUMENTS

DE 3008180 A1 * 9/1981 ..... F02B 37/02
FR 1195314 A * 11/1959 ..... F04D 29/2211

(Continued)

OTHER PUBLICATIONS

Communication dated Jun. 16, 2022 by the Korean Intellectual Property Office in counterpart Korean Patent Application No. 10-2018-0034401.

*Primary Examiner* — Kenneth Bomberg
*Assistant Examiner* — Adam W Brown
(74) *Attorney, Agent, or Firm* — Sughrue Mion, PLLC

(57) ABSTRACT

A dual impeller includes: a hub configured to rotate about a rotation axis; a plurality of first blades which are disposed on a first surface of the hub along a circumferential direction of the hub; a first shroud which is mounted on the plurality of first blades to cover the plurality of first blades; and a plurality of second blades which are disposed on a first surface of the first shroud along a circumferential direction of the first shroud.

16 Claims, 8 Drawing Sheets

(56) References Cited

U.S. PATENT DOCUMENTS

| | | | | |
|---|---|---|---|---|
| 2015/0063991 | A1* | 3/2015 | Wang | F01D 9/026 415/187 |
| 2016/0108921 | A1* | 4/2016 | Ishikawa | F04D 29/4206 415/204 |

FOREIGN PATENT DOCUMENTS

| | | | | |
|---|---|---|---|---|
| GB | 272713 | A * | 6/1927 | F04D 29/2211 |
| JP | 2013-133748 | A | 7/2013 | |
| KR | 10-0484057 | B1 | 4/2005 | |
| KR | 10-0545834 | B1 | 1/2006 | |
| KR | 10-2010-0004740 | A | 1/2010 | |
| WO | 2010/115667 | A1 | 10/2010 | |

* cited by examiner

DUAL IMPELLER

BACKGROUND

1. Field

Exemplary embodiments relate to an impeller, and more particularly, to a dual impeller having two separate flow paths.

2. Description of the Related Art

A centrifugal compressor is a device that compresses a fluid by applying a centrifugal force to the fluid using a rotating impeller.

The centrifugal compressor of the related art includes a driver which produces a driving force, a gear unit which is connected to the driver, a gear box which is installed inside the gear unit, a rotating shaft which is inserted into the gear box and connected to the gear unit, an impeller which is connected to the rotating shaft and rotates to transfer kinetic energy to a fluid so as to increase the pressure of the fluid, a scroll which supports the impeller, and a shroud which is coupled to the scroll to form an internal space through which a fluid flows.

The operation of the compressor is limited by a choke in high-flow conditions and by a surge in low-flow conditions. When a choke or a surge occurs during the operation of the compressor, the impeller rotating at high speed generates a large vibration with a loud noise and can be damaged. That is, when a choke or surge occurs during the operation of the compressor, the compressor cannot function in a normal operation mode and must be shut down. Therefore, various attempts have been made to expand the available operation range of the compressor to avert frequent occurrences of a choke or a surge.

The outset of the surge or the choke of the compressor and the stable operation range compressor are determined by flow characteristics in a flow path of the compressor and are influenced by the number, arrangement interval, size, shape, etc. of blades constituting the impeller. Therefore, the shape of the impeller suitable for each flow characteristic is different. In an impeller in the related art where the impeller includes blades of a certain type and of a certain shape, a method such as casing treatment only be used to widen the operation range by controlling the flow characteristics of a fluid.

SUMMARY

Aspects of one or more exemplary embodiments provide an impeller in which a flow path is diversified according to a component of a fluid.

However, aspects of the invention concept are not restricted to the one set forth herein. The above and other aspects of the inventive concept will become more apparent to one of ordinary skill in the art to which the inventive concept pertains by referencing the detailed description of the inventive concept given below.

According to an aspect of an exemplary embodiment, there is provided a dual impeller including: a hub configured to rotate about a rotation axis; a plurality of first blades which are disposed on a first surface of the hub along a circumferential direction of the hub; a first shroud which is mounted on the plurality of first blades to cover the plurality of first blades; and a plurality of second blades which are disposed on a first surface of the first shroud along a circumferential direction of the first shroud.

A second shroud which is mounted on the second blades to cover the second blades may be included.

The dual impeller includes a plurality of first flow paths defined by the hub, the first blades and the first shroud, and a plurality of second flow paths defined by the first shroud, the second blades and the second shroud, wherein inlets of the first flow paths and inlets of the second flow paths are formed at an end of the hub in the direction of the rotation axis and are open in a direction parallel to the rotation axis, and outlets of the first flow paths and outlets of the second flow paths are open radially along the circumference of the hub.

The outlets of the first flow paths may be disposed farther from the end of the hub than the outlets of the second flow paths in the direction parallel to the rotation axis.

The first flow paths may have a first operation region, and the second flow paths may have a second operation region.

A number of the first blades and a number of the second blades may be different from each other.

BRIEF DESCRIPTION OF THE DRAWINGS

The above and/or other aspects will become apparent and more readily appreciated from the following description of the embodiments, taken in conjunction with the accompanying drawings in which.

DETAILED DESCRIPTION

Figure 1:
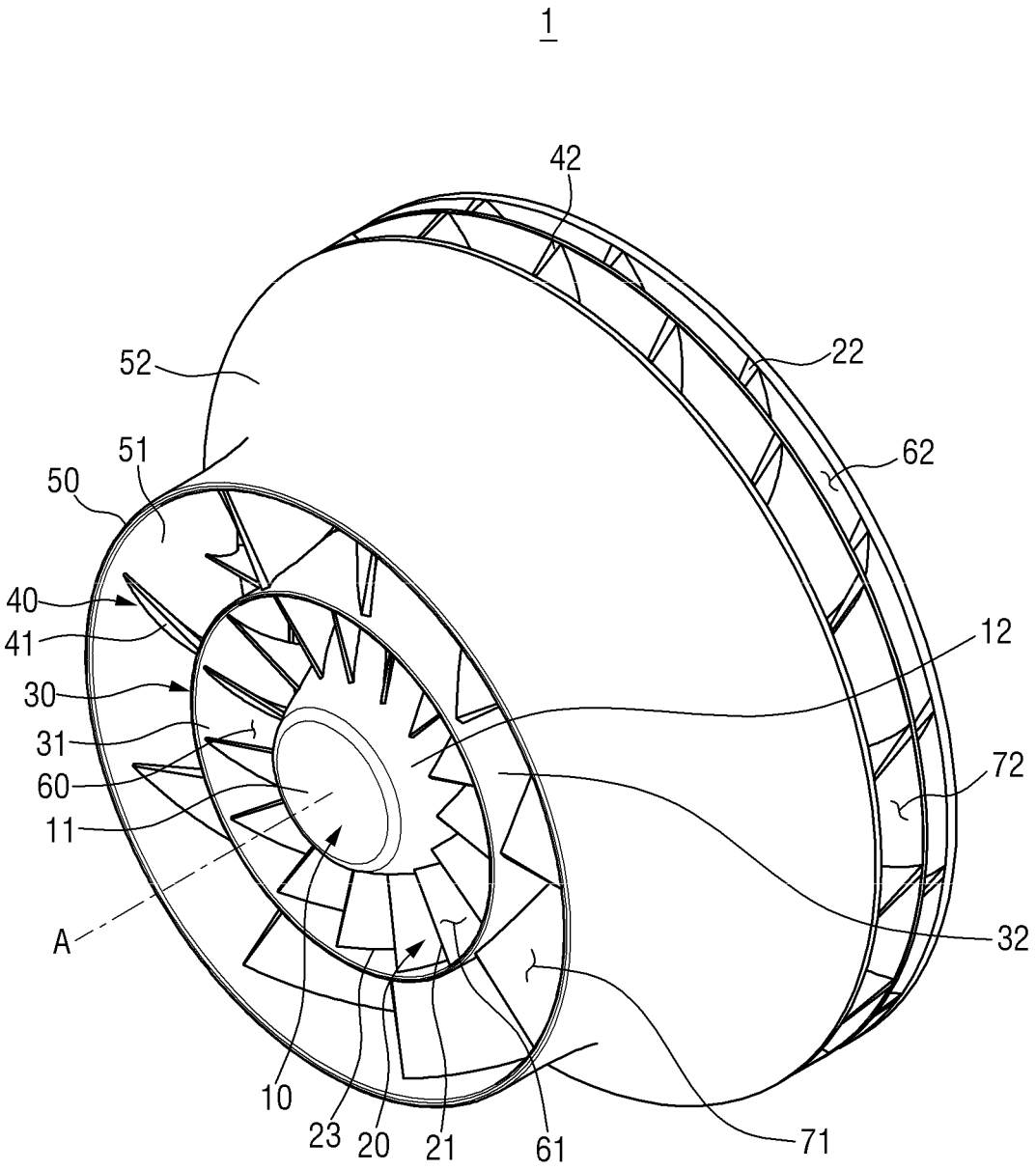
FIG. 1 is a perspective view of the exterior of a dual impeller according to an embodiment of the inventive concept.

The disclosure will now be described more fully hereinafter with reference to the accompanying drawings, in which exemplary embodiments of the inventive concept are shown. The inventive concept may, however, be embodied in different forms and should not be construed as limited to the exemplary embodiments set forth herein. Rather, these exemplary embodiments are provided so that this disclosure will be thorough and complete, and will filly convey the scope of the inventive concept to one of ordinary skill in the art. The same reference numbers indicate the same components throughout the specification. In the attached figures, the thickness of layers and regions is exaggerated for clarity.

Unless defined otherwise, all technical and scientific terms used herein have the same meaning as commonly understood by one of ordinary skill in the art to which the disclosure belongs. It is noted that the use of any and all examples, or exemplary terms provided herein is intended merely to better illuminate the inventive concept and is not a limitation on the scope of the inventive concept unless otherwise specified. Further, unless defined otherwise, all terms defined in generally used dictionaries may not be overly interpreted.

The use of the terms "a" and "an" and "the" and similar referents in the context of describing the inventive concept (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Further, the exemplary embodiments described herein will be described with reference to cross-sectional views and/or schematic drawings that are ideal exemplary figures of the present disclosure. Thus, the shape of the exemplary figures can be modified by manufacturing techniques and/or tolerances. Further, in the drawings of the disclosure, each component may be somewhat enlarged or reduced in view of convenience of explanation. Reference numerals refer to same elements throughout the specification and "and/or" include each and every combination of one or more of the mentioned items.

Spatially relative terms should be understood to be terms that include different orientations of components during use or operation in addition to those shown in the drawings. The components can also be oriented in different directions, so that spatially relative terms can be interpreted according to orientation.

Exemplary embodiments of the present disclosure will hereinafter be described with reference to the accompanying drawings.

Figure 2:
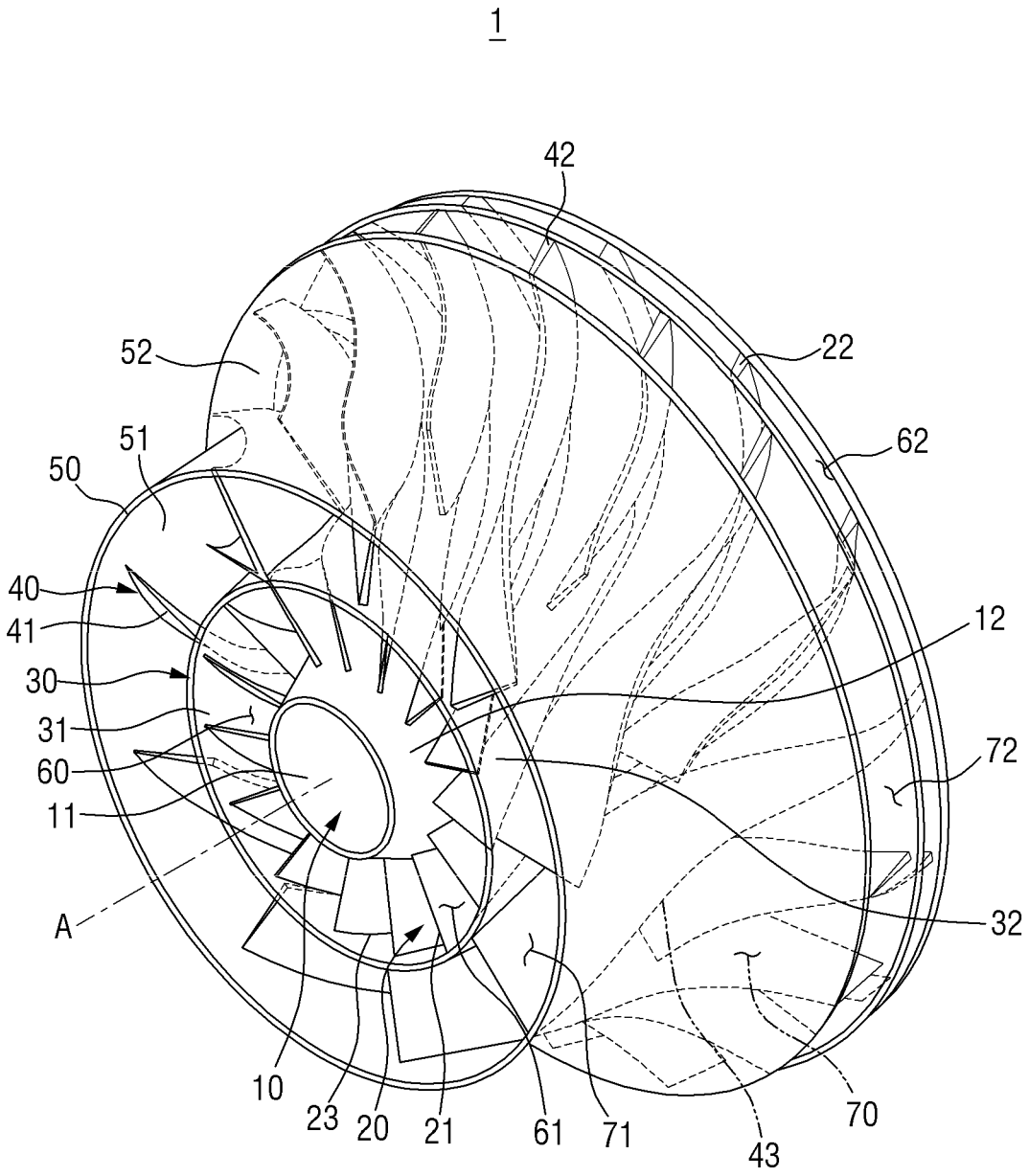
FIG. 2 is a perspective view of the exterior and part of the internal structure of the dual impeller illustrated in FIG. 1.

FIG. 1 is a perspective view of the exterior of a dual impeller 1 according to an exemplary embodiment of the inventive concept. FIG. 2 is a perspective view of the exterior and part of the internal structure of the dual impeller 1 illustrated in FIG. 1.

Referring to FIGS. 1 and 2, the dual impeller 1 according to the exemplary embodiment includes a hub 10, a plurality of inner (first) blades 20 which are mounted on the hub 10, an inner (first) shroud 20 which covers the inner blades 20, a plurality of outer (second) blades 40 which are formed along an outer circumference of the inner shroud 30, and an outer (second) shroud 50 which covers the outer blades 40.

The hub 10 is a body portion or a base portion of the dual impeller 1 and has a cone-like shape in which a diameter gradually decreases as it extends from a disk (or a base) of the cone in the direction of a rotation axis A that passes through a vertex of the cone. However, unlike a cone, the hub 10 does not have a vertex at an end. Instead, a first end 11 of the hub 10 forms a circle having a smaller diameter than a circle formed by a second end 14 of the hub 10. Because the hub 10 discharges a high-pressure fluid through high-speed rotation, it is made of a material having strength and hardness sufficient to withstand high pressure. The material that forms the hub 10 may be, but is not limited to, a metal, preferably, stainless steel, titanium or the like.

The hub 10 is connected to a drive shaft (not illustrated) which passes through a center portion 13 (FIGS. 5-7) of the hub 10. The drive shaft is connected to an external power source (not illustrated) and a gear unit (not illustrated) which transmits a driving force generated by the external power source. Thus, the drive shaft receives the driving force and rotates in place.

The drive shaft passes through the center portion 13 of the hub 10 and is disposed parallel to the rotation axis A of the dual impeller 1 according to the exemplary embodiment to serve as a rotating shaft of the hub 10. The drive shaft is engaged with the center portion 13 of the hub 10 so as not to slip with respect to each other, and the hub 10 rotates in accordance with the rotation of the drive shaft. The drive shaft may have a cylindrical shape that is symmetrical with respect to the rotation axis A. This is to maintain the symmetry of the entire dual impeller 1.

The inner blades 20 are formed on an outer surface 12 of the hub 10. The inner blades 20 guide the movement of a fluid while transferring kinetic energy of the dual impeller 1 to the fluid. The inner blades 20 and the hub 10 may be welded together, fastened together by screws, or integrally formed with each other. However, the method used to mount the inner blades 20 on the hub 10 and couple the inner blades 20 to the hub 10 is not limited to the above-described exemplary embodiment.

The inner blades 20 are disposed on the outer surface 12 of the hub 10 along the circumference of the hub 10 (i.e., along a circumferential direction of the hob 10) and are spaced apart from one another by a predetermined distance. The inner blades 20 extend radially from the outer surface 12 of the hub 10 but do not extend straightly from the outer surface 12 of the hub 10 along the diameter of the hub 10. Each of the inner blades 20 extends radially from the outer surface 12 of the hub 10 and is curved on a vertical plane along a radial direction of the hub 10. Thus, as can be seen in the figures of the disclosure, the inner blades 20 bend in a direction from the outer surface 12 of the hub 10. That is, the inner blades 20 have a camber structure.

The inner blades 20 extend from a first end in the direction of the rotation axis A to a second end opposite to the first end along the outer surface 12 of the hub 10. Therefore, in a cross-section taken along a plane orthogonal to the rotation axis A, the diameter of a circle formed by connecting outermost end points of the inner blades 20 changes along the direction of the rotation axis A. The circle has the smallest diameter at the first end 11 of the hub 10 in the direction of the rotation axis A into which a fluid is introduced and has the largest diameter at the second end 14 of the hub 10 in the direction of the rotation axis A from which the fluid is discharged. Because the radius of the circle formed by connecting the outermost end points of the inner blades 20 becomes smaller, the gap along the circumferential direction between adjacent inner blades 20 also becomes smaller.

A first end of a region of each of the inner blades 20 where a fluid is introduced is referred to as an inner inducer 21, and a second end opposite to the first end of a region of each of the inner blades 20 where the fluid is discharged is referred to as an inner tip 22. Therefore, a part of each of the inner blades 20 disposed adjacent to a region of the hub 10 having the smallest diameter is referred to as the inner inducer 20, and a part of each of the inner blades 20 disposed adjacent to a region of the hub 10 having the largest diameter is referred to as the inner tip 22.

The inner blades 20 may be disposed symmetrically with respect to the rotation axis A that passes through the center portion 13 of the hub 10. Because the inner blades 20 rotate around the rotation axis A, it is difficult to maintain a uniform performance unless the inner blades 20 are symmetrical. That is, the outermost ends in the radial direction of the inner blades 20 have the same length from the rotation axis.

Figure 8:
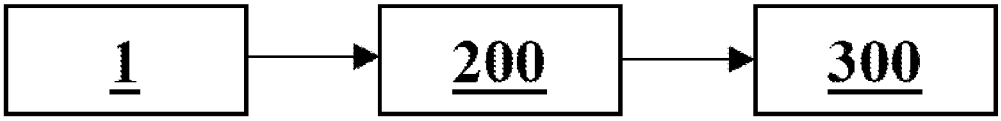
FIG. 8 is a block diagram of a system according to an embodiment.

The inner shroud 30 is a component that rests on edges 23 of the inner blades 20. An inner surface 31 of the inner shroud 30 covers the edges 23 of the inner blades 20 so that a fluid does not leak out while passing between the edges 23 of the inner blades 20. The inner blades 20, the inner shroud 30 and the hub 10 serve as sidewalls to form a tunnel (a flow path). Therefore, a fluid does not leak out and is discharged only toward a diffuser 200 (refer to FIG. 8), thereby improving the operating efficiency of the dual impeller 1 according to the exemplary embodiment. A flow path thus formed is referred to as an inner flow path 60.

The inner shroud 30 covers the edges 23 of the inner blades 20, which are front ends of the inner blades 20, but does not cover the inner inducers 21. Therefore, an inlet 61 of the circular inner flow path 60 is formed. A fluid that enters the dual impeller 1 is drawn into the inner flow path 60 through the inlet 61 of the inner flow path 60 and compressed by the rotation of the dual impeller to be discharged to an outlet 62 of the inner flow path 60 which will be described later.

The compressed fluid is discharged to the outlet 62 of the inner flow path 60 formed between the inner shroud 30 and the hub 10. The outlet 62 of the inner flow path 60 is connected to the diffuser 200, and the fluid is discharged to a scroll 300 (refer to FIG. 8) through the diffuser 200, thereby operating a centrifugal compressor. The outlet 62 of the inner flow path 60 will be described in detail later with reference to FIGS. 5 and 6.

The outer blades 40 are formed on an outer surface 32 of the inner shroud 30. The outer blades 40 guide the movement of a fluid while transferring kinetic energy of the dual impeller 1 to the fluid. The outer blades 40 and the inner shroud 30 can be welded together, fastened together by screws, or integrally formed with each other. However, the method used to mount the outer blades 40 on the inner shroud 30 and couple the outer blades 40 to the inner shroud 30 is not limited to the above-described exemplary embodiments.

The outer blades 40 are disposed on the outer surface 32 of the inner shroud 30 along the circumference of the inner shroud 30 and are spaced apart from each other by a predetermined distance. The outer blades 40 extend radially from the outer surface 32 of the inner shroud 30 but do not extend straightly from the outer surface 32 of the inner shroud 30 along the diameter of the inner shroud 30. Each of the outer blades 40 extends radially from the outer surface 32 of the inner shroud 30 and is curved on a vertical plane along a radial direction of the inner shroud 30. Thus, as can be seen in the drawings, the outer blades 40 bend in a direction from the outer surface 32 of the inner shroud 30. That is, the outer blades 40 have a camber structure.

The outer blades 40 extend from the first end in the direction of the rotation axis A to the second end opposite to the first end along the outer surface 32 of the inner shroud 30. Therefore, in a cross-section taken along a plane orthogonal to the rotation axis A, the diameter of a circle formed by connecting outermost end points of the outer blades 40 changes along the direction of the rotation axis A. The circle has the smallest diameter at an end (the first end) of the inner shroud 30 in the direction of the rotation axis A into which a fluid is introduced and has the largest diameter at the other end (the second end opposite to the first end) of the inner shroud 30 in the direction of the rotation axis A from which the fluid is discharged. Because the radius of the circle formed by connecting the outermost end points of the outer blades 40 becomes smaller, the gap in the circumferential direction between adjacent outer blades 40 also becomes smaller.

An end of a region of each of the outer blades 40 where a fluid is introduced is referred to as an outer inducer 41, and the other end of a region of each of the outer blades 40 where the fluid is discharged is referred to as an outer tip 42. Therefore, a part of each of the outer blades 40 disposed adjacent to a region of the inner shroud 30 having the smallest diameter is referred to as the outer inducer 41, and a part of each of the outer blades 40 disposed adjacent to a region of the inner shroud 30 having the largest diameter is referred to as the outer tip 42.

The outer blades 40 may be disposed symmetrically with respect to the rotation axis A that passes through the center of the inner shroud 30. Because the outer blades 40 rotate around the rotation axis A, it is difficult to maintain a uniform performance unless the outer blades 40 are symmetrical. That is, the outermost ends in the radial direction of the outer blades 40 have the same length from the rotation axis.

The number of the outer blades 40 and the number of the inner blades 20 may be equal or different from each other and may be selected according to characteristics of an operation region of each flow path. According to an exemplary embodiment, the number of the outer blades 40 may be nine (9) and the number of the inner blades 20 may be fifteen (15) as described in figures.

The outer shroud 50 is a component that rests on edges 43 of the outer blades 40. More specifically, an inner surface 51 of the outer shroud 50 covers the edges 43 of the outer blades 40 so that a fluid does not leak out while passing between the edges 43 of the outer blades 40. The outer blades 40, the outer shroud 50 and the inner shroud 30 serve as sidewalls to form a tunnel (a flow path). Therefore, a fluid does not leak out and is discharged only toward the diffuser 200, thereby improving the operating efficiency of the dual impeller 1. A flow path thus formed is referred to as an outer flow path 70.

The outer shroud 50 covers the edges 43 of the outer blades 40, which are front ends of the outer blades 40, but does not cover the outer inducers 41. Therefore, an inlet 71 of the circular outer flow path 70 is formed. A fluid that enters the dual impeller 1 of the inventive concept is drawn into the outer flow path 70 through the inlet 71 of the outer flow path 70 and compressed by the rotation of the dual impeller 1 to be discharged to an outlet 72 of the outer flow path 70 which will be described later.

The compressed fluid is discharged to the outlet 72 of the outer flow path 70 formed between the outer shroud 50 and the inner shroud 30. The outlet 72 of the outer flow path 70 is connected to the diffuser 200, and the fluid is discharged to the scroll 300 through the diffuser 200, thereby operating the centrifugal compressor. The outlet 72 of the outer flow path 70 will be described in detail later with reference to FIGS. 5 and 6.

An outer surface 52 of the outer shroud 50 is an outer surface of the dual impeller 1 according to the exemplary embodiment. That is, the outer surface 52 of the outer shroud 50 is an outermost surface of the dual impeller 1 according to the exemplary embodiment.

The hub 10, the inner blades 20, the inner shroud 30, the outer blades 40 and the outer shroud 50 of the dual impeller 1 according to the exemplary embodiment can be integrally formed with each other or coupled to each other by coupling members.

The inner flow path 60 is formed between the inner blades 20. Because a plurality of inner blades 20 are provided, a plurality of inner flow paths 60 are formed. Because the inner blades 20 are formed on the outer surface 12 of the hub 10, the outer surface 12 of the hub 10 serves as a bottom surface of each inner flow path 60, and the inner blades 20 serve as sidewalls of the inner flow path 60. In addition, because the edges 23 of the inner blades 20 are covered by the inner shroud 30, the inner shroud 30 serves as an upper wall of the inner flow path 60. That is, each inner flow path 60 is surrounded by the hub 10, the inner blades 20, and the inner shroud 30. A fluid passing through the dual impeller 1 is forced to pass through the closed or nearly closed inner flow path 60, so that it can be compressed efficiently.

Like the inner flow path 60, the outer flow path 70 is formed between the outer blades 40. Because a plurality of outer blades 40 are provided, a plurality of outer flow paths 70 are formed. Because the outer blades 40 are formed on the outer surface 32 of the inner shroud 30, the outer surface 32 of the inner shroud 30 serves as a bottom surface of each outer flow path 70, and the outer blades 40 serve as sidewalk; of the outer flow path 70 Because the edges 43 of the outer blades 40 are covered by the outer shroud 50, the outer shroud 50 serves as an upper wall of the outer flow path 70. That is, each outer flow path 70 is surrounded by the inner shroud 30, the outer blades 40, and the outer shroud 50.

The inlet 61 of the inner flow path 60 and the inlet 71 of the outer flow path 70 of the dual impeller 1 according to the exemplary embodiment will hereinafter be described with reference to FIGS. 3 and 4.

Figure 3:
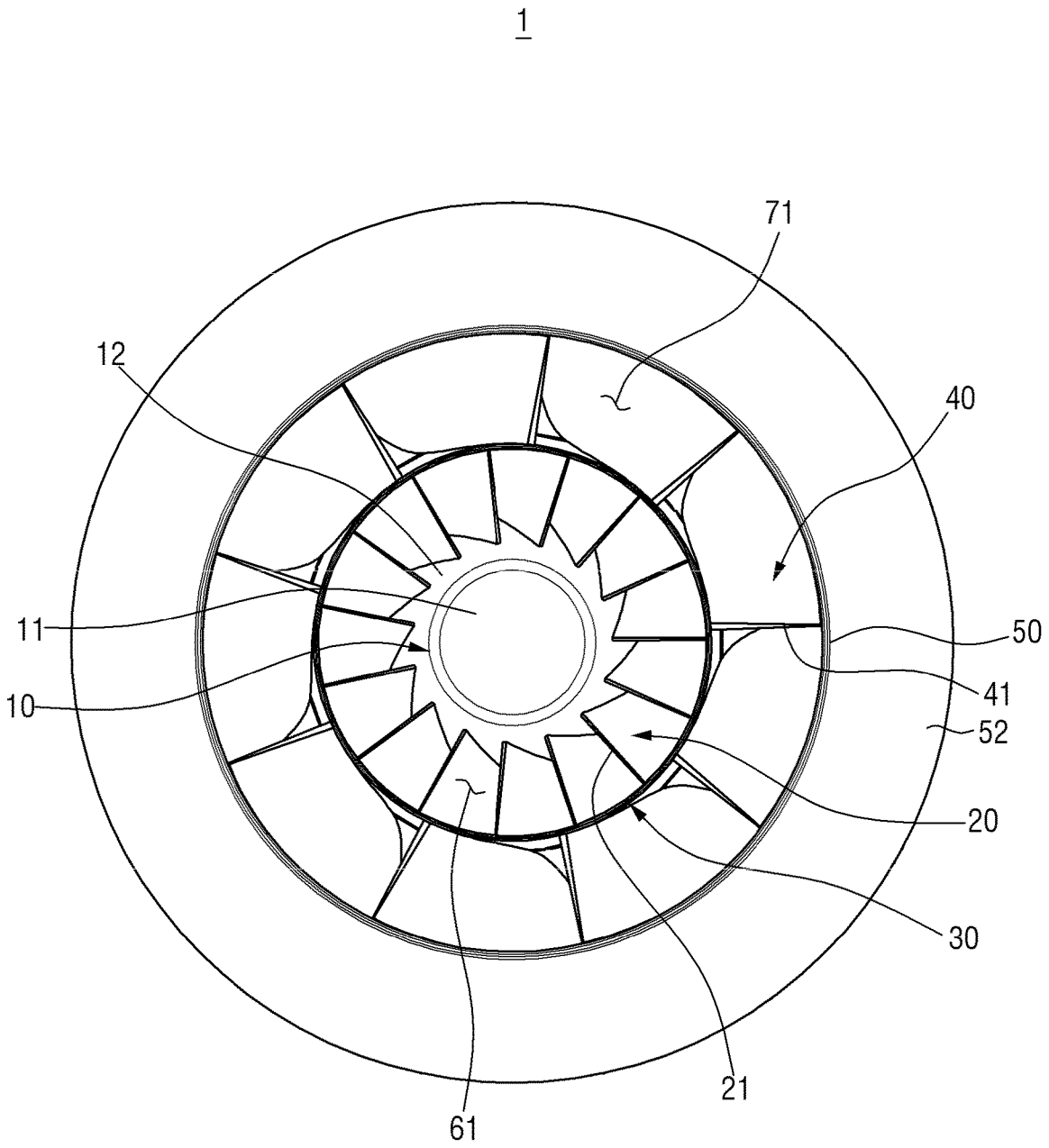
FIG. 3 is a front view of the dual impeller illustrated in FIG. 1.

FIG. 3 is a front view of the dual impeller 1 illustrated in FIG. 1. FIG. 4 is a front view of the exterior and part of the internal structure of the dual impeller 1 illustrated in FIG. 1.

The inlet 61 of the inner flow path 60 is an opening open to allow a fluid to enter the inner flow path 60. The inlet 61 is formed at the first end 11 of the hub 10 in the direction of the rotation axis A and open in a direction parallel to the rotation axis A. Because the inner flow path 60 is formed in a plurality, the inlet 61 of the inner flow path 60 is also formed in a plurality. The inner inducers 21, the hub 10, and the inner shroud 30 serve as boundary surfaces of the inlet 61 of the inner flow path 60.

Like the inlet 61 of the inner flow path 60, the inlet 71 of the outer flow path 70 is an opening open to allow a fluid to enter the outer flow path 70. The inlet 71 is formed at the first end 11 of the hub 10 in the direction of the rotation axis A and open in the direction parallel to the rotation axis A. Because the outer flow path 70 is formed in a plurality, the inlet 71 of the outer flow path 70 is also formed in a plurality. The outer inducers 41, the inner shroud 30 and the outer shroud 50 serve as boundary surfaces of the inlet 71 of the outer flow path 70.

Figure 4:
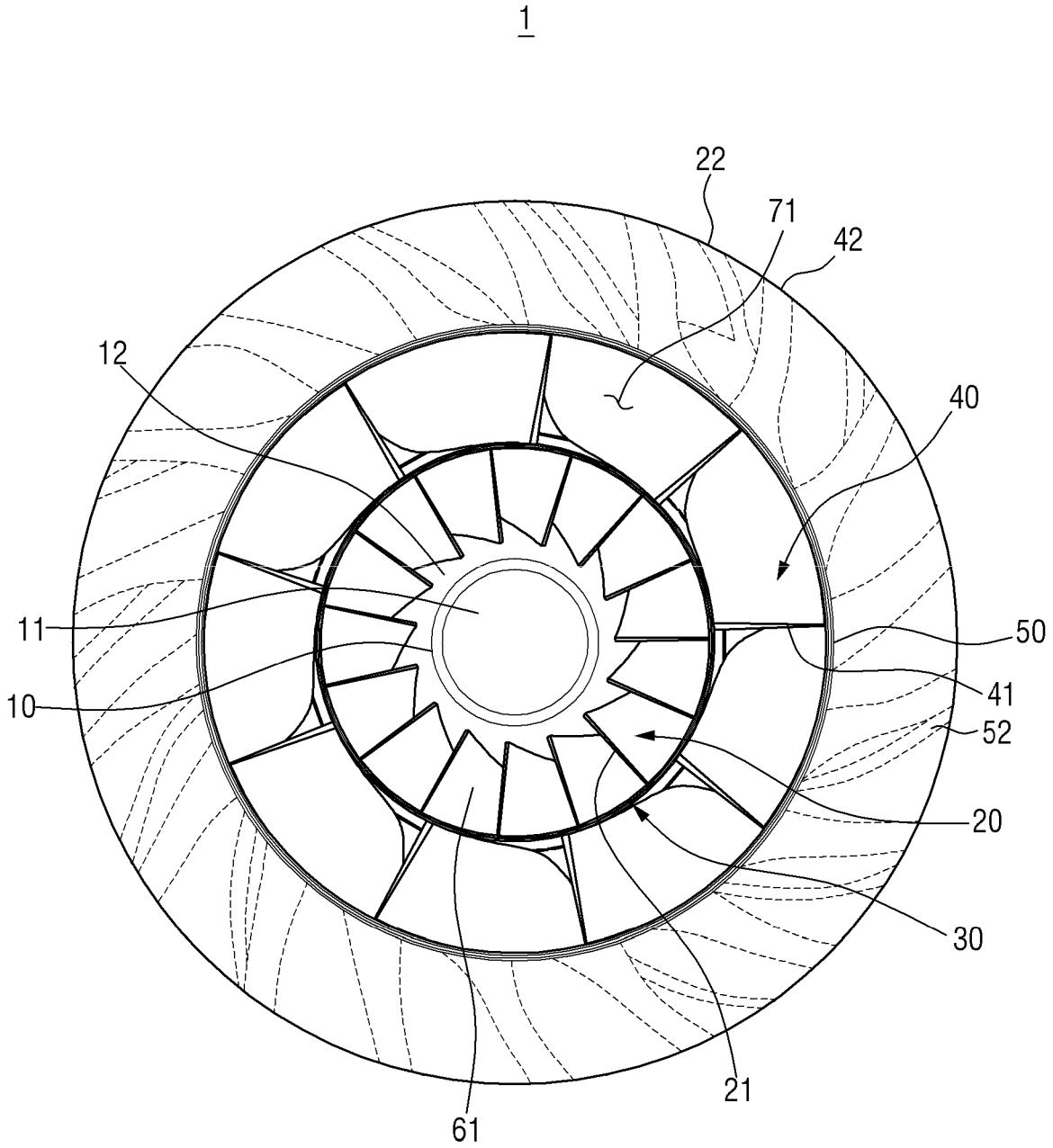
FIG. 4 is a front view of the exterior and part of the internal structure of the dual impeller illustrated in FIG. 1.

As illustrated in FIGS. 3 and 4, the inlets 61 of the inner flow paths 60 surround the first end 11 of the hub 10 and are formed adjacent to the first end 11 of the hub 10, but the inlets 71 of the outer flow paths 70 surround the inner flow paths 60 because they are located further outside in the radial direction than the inner flow paths 60. Therefore, when the dual impeller 1 of the inventive concept is viewed from the first end in the direction of the rotation axis A, the hub 10, the inner flow paths 60, and the outer flow paths 70 form concentric circles.

The outlet 62 of the inner flow path 60 and the outlet 72 of the outer flow path 70 of the dual impeller 1 according to the exemplary embodiment will now be described with reference to FIGS. 5 and 6.

Figure 5:
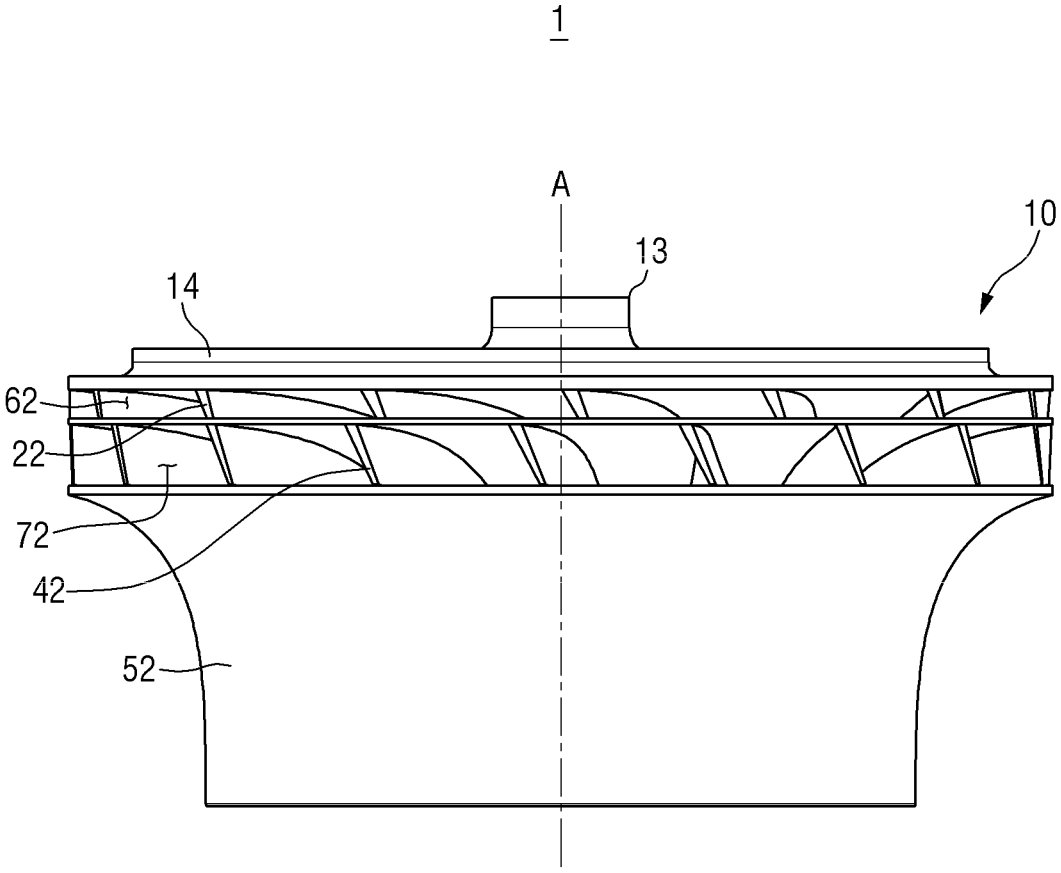
FIG. 5 is a side view of the dual impeller illustrated in FIG. 1 according to an exemplary embodiment.
Figure 6:
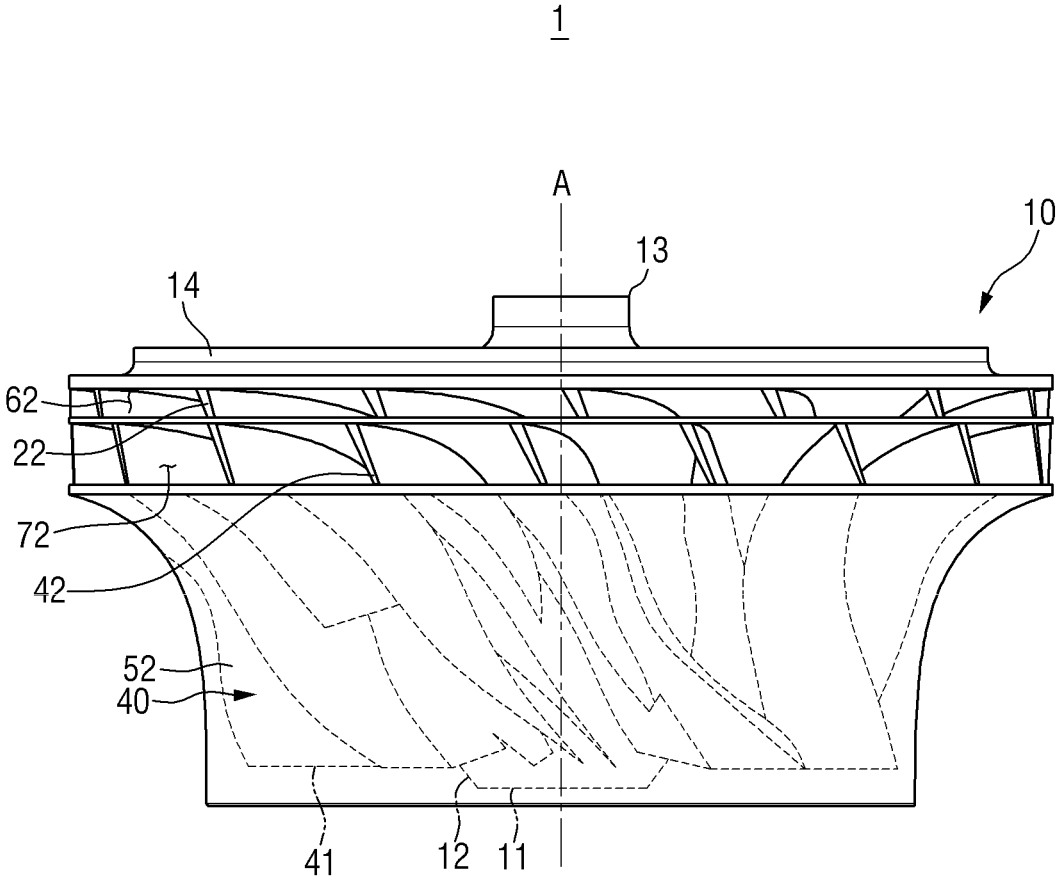
FIG. 6 is a side view of the exterior and part of the internal structure of the dual impeller illustrated in FIG. 1.

FIG. 5 is a side view of the dual impeller 1 illustrated in FIG. 1. FIG. 6 is a side view of the exterior and part of the internal structure of the dual impeller 1 illustrated in FIG. 1 according to an exemplary embodiment.

When the inlet 61 of the inner flow path 60 is located at an end of the inner flow path 60, the outlet 62 of the inner flow path 60 is located at the other end of the inner flow path 60. The outlet 62 of the inner flow path 60 is an opening through which a fluid drawn into the inner flow path 60 escapes. The inner tips 22, the hub 10 and the inner shroud 30 serve as boundary surfaces of the outlet 62 of the inner flow path 60.

The outlet 62 of the inner flow path 60 may be open in the radial direction of the hub 10. Therefore, the outlet 62 is open in a direction orthogonal to the rotation axis A and formed radially along the outer circumference of the hub 10. Because the inner flow path 60 is formed in a plurality, the outlet 62 of the inner flow path 60 is also formed in a plurality.

When the inlet 71 of the outer flow path 70 is located at an end (a first end) of the outer flow path 70, the outlet 72 of the outer flow path 70 is located at the other end (a second end opposite to the first end) of the outer flow path 70. The outlet 72 of the outer flow path 70 is an opening through which a fluid drawn into the outer flow path 70 escapes, and the outer tips 42, the inner shroud 30 and the outer shroud 50 serve as boundary surfaces of the outlet 72 of the outer flow path 70.

The outlet 72 of the outer flow path 70 may be open in the radial direction of the hub 10. Therefore, the outlet 72 is open in the direction orthogonal to the rotation axis A and formed radially along the outer circumference of the inner shroud 30. Because the outer flow path 70 is formed in a plurality, the outlet 72 of the outer flow path 70 is also formed in a plurality.

The outlet 62 of the inner flow path 60 and the outlet 72 of the outer flow path 70 are connected to the diffuser 200, and a fluid that passes through the inner flow path 60 and the outer flow path 70 is discharged to the diffuser 200 through the outlets 62 and 72. The process in which and characteristics with which a fluid passes through the inner flow path 60 and the outer flow path 70 will be described later with reference to FIG. 7.

The inlet 61 of the inner flow path 60 and the inlet 71 of the outer flow path 70 are open in the direction parallel to the rotation axis A, and the outlet 62 of the inner flow path 60 and the outlet 72 of the outer flow path 70 are open radially along the outer circumference of the hub 10, that is, in the direction orthogonal to the rotation axis A. Therefore, the flow direction of a fluid changes as the fluid passes through the dual impeller 1 of the inventive concept.

In the direction parallel to the rotation axis A, the outlet 62 of the inner flow path 60 is disposed at a position farther from the first end 11 of the hub 10 than a position where the outlet 72 of the outer flow path 70 is disposed. The outlet 62 of the inner flow path 60 and the outlet 72 of the outer flow path 70 are arranged parallel to each other along the direction of the rotation axis A. However, because the outer flow path 70 surrounds or covers the inner flow path 60, the outlet 62 of the inner flow path 60 is disposed farther from the first end 11 of the hub 10 than the outlet 72 of the outer flow path 70.

Figure 7:
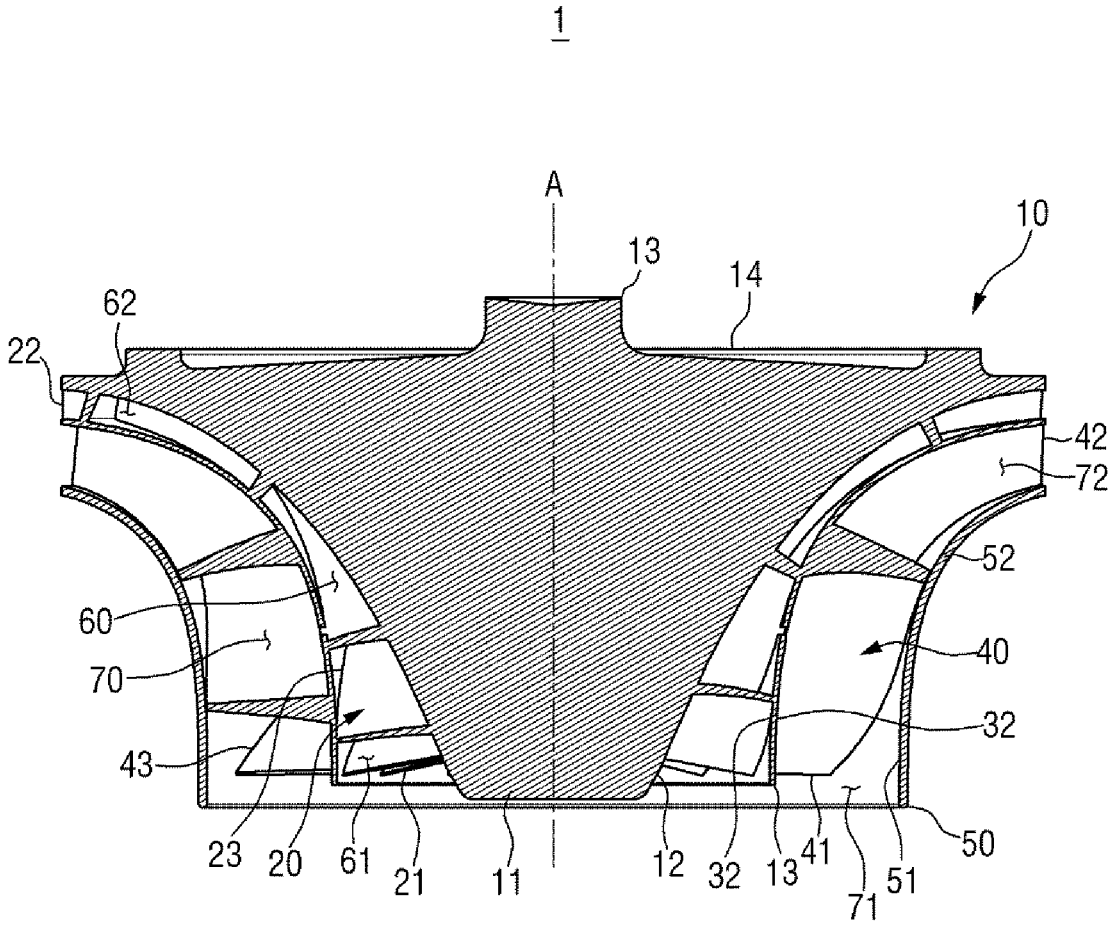
FIG. 7 is a side cross-sectional view of the dual impeller illustrated in FIG. 1.

FIG. 7 is a side cross-sectional view of the dual impeller 1 illustrated in FIG. 1.

Referring to FIG. 7, the relationship between the inner flow path 60 and the outer flow path 70 can be identified. The inner flow path 60 is formed to surround the outer surface 12 of the hub 10 excluding the first and second ends 11 and 14 in the direction of the rotation axis A, and the outer flow path 70 is formed to surround the outer surface 32 of the inner shroud 30 that forms an outer surface of the inner flow path 60.

When a centrifugal compressor starts to operate, a fluid is introduced from the outside into the inner flow path 60 and the outer flow path 70 through a space between the inner inducers 21 and a space between the outer inducers 41. As the hub 10 rotates about the rotation axis A, the inner blades 20 formed on the outer surface 12 of the hub 10 and the outer blades 40 formed on the outer surface 32 of the inner shroud 30 which covers the inner blades 20 rotate, thereby transferring kinetic energy to the introduced fluid. The transferred kinetic energy changes to static pressure energy as the fluid passes through the inner flow path 60 and the outer flow path 70 and moves toward the periphery of the hub 10 along the inner flow path 60 and the outer flow path 70. That is, the fluid that has entered the inner flow path 60 and the outer flow path 70 is compressed. The compressed fluid is discharged to the space between the inner tips 22 and the space between the outer tips 42. Because the outlet 62 of the inner flow path 60 and the outlet 72 of the outer flow path 70 are connected to the diffuser 200 that surrounds the outer circumference of the dual impeller 1 of the inventive concept, the discharged fluid is introduced into the diffuser 200 and guided to the scroll 300.

The number of the inner blades 20 and the number of the outer blades 40 may be different from each other. Even if the number of the inner blades 20 and the number of the outer blades 40 are not different, the inner blades 20 and the outer blades 40 are not arranged in exactly the same form because the outer blades 40 are disposed outside the inner blades 20. Therefore, an operation region in which the inner blades 20 can compress a fluid through the inner flow path 60 is different from an operation region in which the outer blades 40 can compress a fluid through the outer flow path 70. The former is referred to as a first operation region, and the latter is referred to as a second operation region. Here, an operation region denotes a flow range or a flow rate range in which the dual impeller 1 of the inventive concept including the blades 20 and 40 can stably compress an introduced fluid and discharge the compressed fluid without a surge or a choke.

The inner flow path 60 is formed in a structure suitable for compressing a low-speed fluid. The number of the inner blades 20 constituting the inner flow path 60 may be set to be greater than the number of the outer blades 40, and an angle formed between adjacent inner blades 20 may be set to be smaller than an angle formed between adjacent outer blades 40, thereby increasing the flow rate of an introduced fluid.

On the other hand, the outer flow path 70 is formed in a structure suitable for compressing a high-speed fluid. The number of the outer blades 40 constituting the outer flow path 70 may be set to be smaller than the number of the inner blades 20, and the angle formed between adjacent outer blades 40 may be set to be larger than the angle formed between adjacent inner blades 20, thereby reducing the flow rate of an introduced fluid. Therefore, the first operation region is a low-speed operation region, and the second operation region is a relatively high-speed operation region as compared with the first operation region.

The low-speed fluid does not necessarily enter the inner flow path 60, or the high-speed fluid does not necessarily enter the outer flow path 70. However, when the low-speed fluid enters the inner flow path 60 and the outer flow path 70, a surge may occur in the outer flow path 70, whereas the fluid is smoothly compressed in the inner flow path 60, thereby enabling the dual impeller 1 of the inventive concept to operate normally. Conversely, when the high-speed fluid enters the inner flow path 60 and the outer flow path 70, a choke may occur in the inner flow path 60, whereas the fluid is smoothly compressed in the outer flow path 70, thereby enabling the dual impeller 1 of the inventive concept to operate normally. In this way, the dual impeller 1 of the inventive concept has a wider operation region than a general impeller. That is, the range of the sum of the first operation region and the second operation region is wider than the range of the operation region of the general impeller.

It will be understood by one of ordinary skilled in the art that the inventive concept of the disclosure may be embodied in other specific forms without departing from the technical idea or essential characteristics thereof. It is therefore to be understood that the exemplary embodiments described above are illustrative in all aspects and not restrictive. The scope of the inventive concept is defined by the appended claims rather than the detailed description and all changes or modifications derived from the meaning and scope of the claims and their equivalents are to be construed as being included within the scope of the disclosure.

Although exemplary embodiments have been disclosed for illustrative purposes, one of ordinary skilled in the art will appreciate that various modifications, additions and substitutions are possible, without departing from the scope and spirit of the inventive concept as disclosed in the accompanying claims.

What is claimed is:

1. A compressor comprising:

a dual impeller comprising:

a hub configured to rotate about a rotation axis;

a plurality of first blades which are disposed on a first surface of the hub along a circumferential direction of the hub;

a first shroud which is mounted on the plurality of first blades to cover the plurality of first blades;

a plurality of second blades which are disposed on a first surface of the first shroud along a circumferential direction of the first shroud;

a second shroud which is mounted on the plurality of second blades to cover the plurality of second blades;

a plurality of first flow paths defined by the hub, the plurality of first blades, and the first shroud; and a plurality of second flow paths defined by the first shroud, the plurality of second blades, and the second shroud, wherein a first angle formed between adjacent first blades, with the rotation axis as a vertex of the first angle, is smaller than a second angle formed between adjacent second blades, with the rotation axis as a vertex of the second angle, wherein inlets of the plurality of first flow paths and inlets of the plurality of second flow paths are disposed at an end of the hub, wherein outlets of the plurality of first flow paths and outlets of the plurality of second flow paths are open in a radial direction of the dual impeller, wherein first ends of the plurality of first blades and the plurality of second blades are located at the inlets of the plurality of first flow paths and the inlets of the plurality of second flow paths, respectively, wherein second ends of the plurality of first blades and the plurality of second blades, that are opposite the first ends, comprise tips that are located at the outlets of the plurality of first flow paths and the outlets of the plurality of second flow paths, respectively, wherein the tips of the plurality of first blades and the plurality of second blades face the radial direction of the dual impeller, and wherein the compressor further comprises:

a diffuser connected to the outlets of the plurality of first flow paths and the outlets of the plurality of second flow paths; and a scroll connected to the diffuser such that fluid from the first flow paths and fluid from the second flow paths is discharged to the scroll through the diffuser.

2. The compressor of claim 1, wherein the inlets of the plurality of first flow paths and the inlets of the plurality of second flow paths are open in a direction parallel to the rotation axis.

3. The compressor of claim 1, wherein the outlets of the plurality of first flow paths and the outlets of the plurality of second flow paths are open radially along the circumferential direction of the hub.

4. The compressor of claim 1, wherein the outlets of the plurality of first flow paths are disposed farther from the end of the hub than the outlets of the plurality of second flow paths along an axial direction of the dual impeller.

5. The compressor of claim 1, wherein the inlets of the plurality of first flow paths surround the end of the hub.

6. The compressor of claim 5, wherein the inlets of the plurality of second flow paths surround the plurality of first flow paths.

7. The compressor of claim 6, wherein the inlets of the plurality of first flow paths and the inlets of the plurality of second flow paths form concentric circles.

8. The compressor of claim 1, wherein the plurality of first flow paths have a first operation region, and the plurality of second flow paths have a second operation region.

9. The compressor of claim 8, wherein the first operation region is a first speed operation region and the second operation region is a second speed operation region, the second speed operation region being faster than the first speed operation region.

10. The compressor of claim 1, wherein a number of the plurality of first blades and a number of the plurality of second blades are different from each other.

11. The compressor of claim 10, wherein the number of the plurality of first blades is greater than the number of the plurality of second blades.

12. The compressor of claim 1, wherein the plurality of second blades are provided farther away from the rotation axis than the plurality of first blades.

13. The compressor of claim 1, wherein the adjacent first blades are spaced apart from each other by a first predetermined distance, and wherein the adjacent second blades are spaced apart from each other by a second predetermined distance different from the first predetermined distance.

14. The compressor of claim 1, wherein in response to a surge occurring in the plurality of second flow paths, a fluid is compressed in the plurality of first flow paths for the dual impeller to operate without effects of the surge.

15. The compressor of claim 1, wherein in response to a choke occurring in the plurality of first flow paths, a fluid is compressed in the plurality of second flow paths for the dual impeller to operate without effects of the choke.

16. The compressor of claim 1, wherein each of the plurality of first blades is a same size as each other.

* * * * *